US006583229B2

(12) United States Patent
Mano et al.

(10) Patent No.: US 6,583,229 B2
(45) Date of Patent: Jun. 24, 2003

(54) SOLID GOLF BALL

(75) Inventors: Satoshi Mano, Kobe (JP); Masatoshi Yokota, Kobe (JP); Kiyoto Maruoka, Kobe (JP); Seigou Sakagami, Kobe (JP); Tetsuo Yamaguchi, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/863,366

(22) Filed: May 24, 2001

(65) Prior Publication Data

US 2003/0050136 A1 Mar. 13, 2003

(30) Foreign Application Priority Data

May 24, 2000 (JP) ..... 2000-153161

(51) Int. Cl.[7] ..... A63B 37/06; C08L 9/00

(52) U.S. Cl. ..... 525/261; 525/245; 525/274; 524/170; 524/357; 524/392; 473/371; 473/372; 473/373; 473/374; 473/377

(58) Field of Search ..... 525/245, 261, 525/274; 524/170, 392, 357; 473/371, 372, 373, 374, 377

(56) References Cited

U.S. PATENT DOCUMENTS

| | | | | |
|---|---|---|---|---|
| 5,252,652 | A | | 10/1993 | Egashira et al. |
| 5,697,856 | A | * | 12/1997 | Moriyama |
| 5,929,171 | A | | 7/1999 | Sano et al. |
| 6,241,625 | B1 | * | 6/2001 | Yokota |
| 6,291,592 | B1 | * | 9/2001 | Bulpett |

FOREIGN PATENT DOCUMENTS

| | | |
|---|---|---|
| JP | 2669051 | 7/1997 |
| JP | 2778229 | 5/1998 |
| JP | 10-244019 | 9/1998 |

* cited by examiner

*Primary Examiner*—David J. Buttner
(74) *Attorney, Agent, or Firm*—Birch, Stewart, Kolasch & Birch, LLP

(57) ABSTRACT

The present invention provides a solid golf ball having exceptional rebound characteristics and flight performance, as well as good shot feel. The present invention relates to a solid golf ball comprising at least one layer of a core, and at least one layer of a cover formed on the core, wherein at least one of the layers of the core is formed by vulcanizing and press-molding a rubber composition comprising a base rubber, co-crosslinking agent, organic peroxide, filler and specific organic sulfur compound which contains substituent groups having a substituent constant of not less than 1.42.

8 Claims, 1 Drawing Sheet

SOLID GOLF BALL

FIELD OF THE INVENTION

The present invention relates to a solid golf ball which has exceptional rebound characteristics and flight performance, as well as a good shot feel.

BACKGROUND OF THE INVENTION

Golf balls can be broadly classified into two categories: solid golf balls, which exhibit exceptional durability and flight distance, and thread-wound golf balls, which exhibit exceptional controllability and shot feel. Solid golf balls comprise a two-piece ball, of which a core is covered by a cover material, and a multi-layer structured golf ball, in which one or more intermediate layers are interposed between the core and cover.

The core of the solid golf balls is formed by a vulcanized molded article of rubber composition. The rubber composition comprises polybutadiene as a base rubber, a metal salt of α,β-unsaturated carboxylic acid and an organic peroxide. The metal salt of α,β-unsaturated carboxylic acid is grafted onto the polybutadiene main chain through the action of the organic peroxide, which serves as a free radical initiator, and functions as a co-crosslinking agent in the rubber composition. Since the vulcanized molded article of the rubber composition forms the three-dimensionally crosslinked structure therein, it is known to impart the core with a suitable degree of hardness and durability, and solid golf balls, in which such cores are employed, with exceptional durability, as well as good rebound characteristics and flight performance.

However, in comparison to conventional thread-wound golf balls, such solid golf balls exhibit a markedly hard shot feel as well as diminished controllability at approach shot. Efforts made to improve the shot feel have included making the core softer by lowering its hardness. The shot feel is improved as a result; however, there is a lowering in rebound characteristics, which does not allow a sufficient flight distance to be obtained. A further test for improving controllability involving softening the cover has been proposed (Japanese Patent Kokai Publication No. 51406/1995). Whereas the spin performance is improved, the rebound characteristics of the cover are degraded, which led to the problem of sufficient ball flight properties not being obtained.

Other attempts to effect a improvement in both the rebound characteristics and shot feel of solid golf balls have been made by compounding conventional core rubber compositions with various organic sulfur compounds (Japanese Patent Kokai Publication No. 244019/1998, Japanese Patent No. 2778229 and Japanese Patent No. 2669051). However, these attempts have still not yielded a golf ball which is satisfactory from the standpoints of both rebound characteristics and shot feel. Moreover, improved shot feel as well as exceptional flight performance have both been increasingly demanded of golf balls.

OBJECTS OF THE INVENTION

With the foregoing problems of conventional golf balls in view, it is an object of the present invention to provide a solid golf ball which has exceptional rebound characteristics and flight performance, together with good shot feel.

The inventors of the present invention performed diligent research in an attempt to achieve the aforedescribed object, and as a result perfected the present invention through the discovery that by employing specific organic sulfur compounds, which contain a substituent group having a substituent constant of at least 1.42, with a core rubber composition containing an α,β-unsaturated carboxylic acid or metal salt of same as a co-crosslinking agent, an organic peroxide, a filler etc. with a polybutadiene or other base rubber, a solid golf ball could be obtained which exhibits exceptional rebound characteristics and flight performance, together with good shot feel.

This object as well as other objects and advantages of the present invention will become apparent to those skilled in the art from the following description with reference to the accompanying drawings.

BRIEF DESCRIPTION OF THE DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
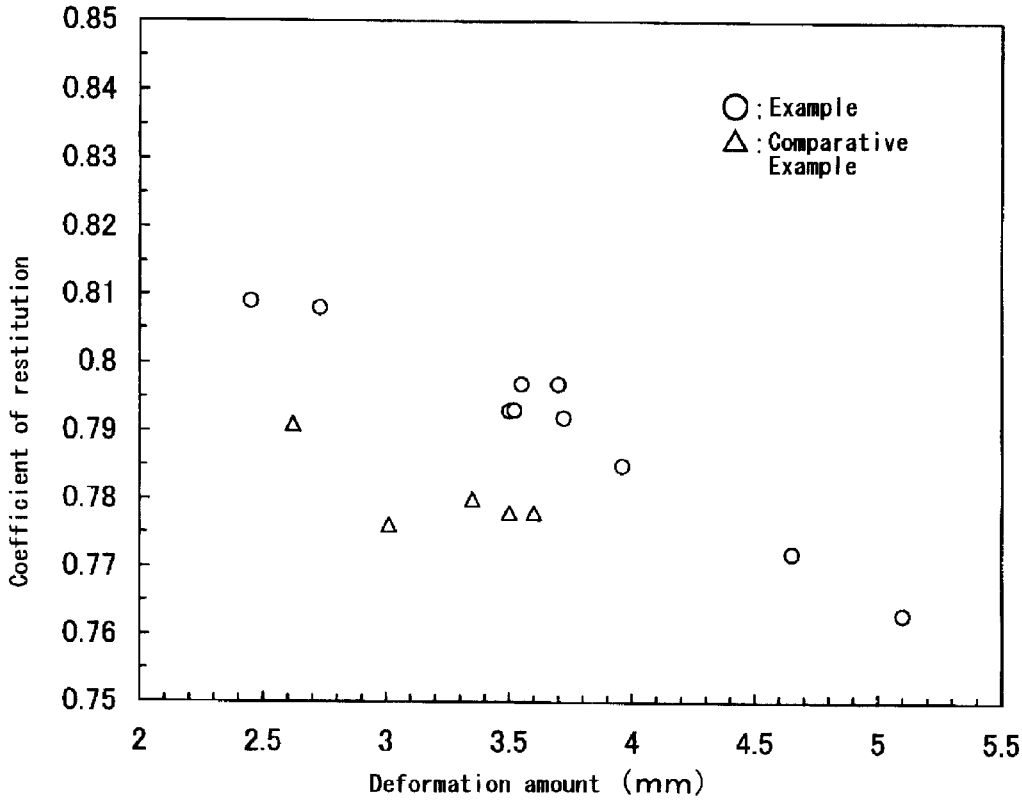
FIG. 1 is a graph displaying the relationship between compression deformation value (x-axis) and rebound characteristics coefficient (y-axis) of the core in the golf ball pertaining to the present invention.

In other words, the present invention relates to a solid golf ball comprising a core of at least one layer, and a cover of at least one layer which covers and is formed on said core, wherein at least one of the layers of said core is formed by vulcanizing a rubber composition which contains (a) a base rubber, (b) a co-crosslinking agent, (c) an organic peroxide, (d) a filler material and (e) one or two or more organic sulfur compounds selected from the group consisting of compounds which are represented by (i) the following Formula (1):

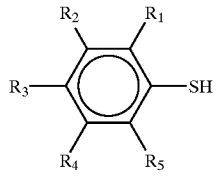

(wherein $R_1$ to $R_5$ are independently a hydrogen or a substituent group, and at least one of $R_1$ to $R_5$ is a substituent group), (ii) Formula (2)

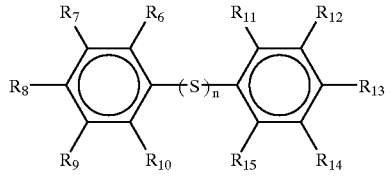

(wherein $R_6$ to $R_{15}$ are independently a hydrogen or a substituent group, at least one of $R_6$ to $R_{10}$ and at least one of $R_{11}$ to $R_{15}$ are substituent groups, and n is an integer of not less than 1), and (iii) Formula (3)

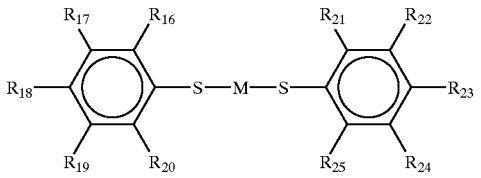

(wherein $R_{16}$ to $R_{25}$ are independently a hydrogen or a substituent group, at least one of $R_{16}$ to $R_{20}$ and at least one of $R_{21}$ to $R_{25}$ are substituent groups, and M represents a bivalent metal atom); and at least one structure represented by the following Formula (4):

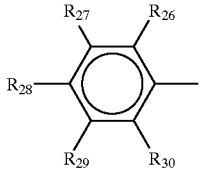

(wherein $R_{26}$ to $R_{30}$ are $R_1$ to $R_5$, $R_6$ to $R_{10}$, $R_{11}$ to $R_{15}$, $R_{16}$ to $R_{20}$, or $R_{21}$ to $R_{25}$)
in Formulae (1) to (3) has a substituent constant of not less than 1.42.

DETAILED DESCRIPTION OF THE INVENTION

"Substituent constant" is defined in accordance with Hammett's rule for the purpose of quantifying the influence of substituents on reaction velocities or equilibria of benzene derivatives, and as is well known, Hammett's rule applies only to meta- or para-substituted benzene derivatives and not to ortho-substituted benzene derivatives. The substituent constant referred to in the case of ortho-substituted benzene derivatives is defined as per the Taft equation, which expands on Hammett's rule.

Hammett's rule, as described in the foregoing, is expressed as the below equation (a):

$$\log(K/K_0)=\rho\sigma$$

(where K represents the reaction value for compounds which contain substituent groups; $K_0$ represents the reaction value for compounds which do not contain substituent groups; i.e., when the substituent group is a hydrogen; ρ represents the reaction constant and σ represents the substituent constant).

The reaction constant (σ) in the above equation (a) is determined according to reaction type and reaction conditions such as temperature and type of solvent, and is 1.00 when substituted benzoic acid is used, and 0.49 when substituted phenyl acetic acid is used.

The substituent constant (σ) in the above equation (a) is only determined according to the type and position of the substituent groups, and not to reaction type. The constant is 0.00 when no substituent group is present; i.e., if the substituent group is a hydrogen, is positive when the substituent group is an electron attractive group, and is negative when the substituent group is an electron donating group. Consequently, the reaction mechanism can be understood from the sign (positive or negative) and magnitude of the aforedescribed substituent constant.

As has been described in the foregoing, Hammett's rule applies only to meta- or para-substituted benzene derivatives; it is not applicable to ortho-substituted benzene derivatives which are susceptible to the influence of steric hindrance etc. Therefore, the Taft equation expands on Hammett's rule by introducing influence from steric hindrance etc. as a positional factor, and thereby allows ortho-substituted benzene derivatives to be taken into account as well. The aforedescribed Taft equation is expressed as the below equation (b):

$$\log(K/K_0)=\rho^*\sigma^*+Es$$

(where K represents the reaction value for compounds which contain substituent groups; $K_0$ represents the reaction value for the aforedescribed compounds which do not contain the aforedescribed substituent groups; i.e., when the substituent group is a hydrogen; ρ* represents the reaction constant; σ* represents the substituent constant and Es represents the substituent group positional constant). Equation (b) above introduces influence from the ortho-substituted benzene derivative steric hindrance etc. as a positional factor; i.e., as the substituent group positional constant Es, and besides the Es component, ρ*σ* in aforedescribed equation (a) has been substituted for ρσ. When the meta-, para- or ortho-positions of the benzene ring contain substituent groups, the substituent constant is obtained by taking the total of σ and σ*.

As has been described in the foregoing, if organic sulfur compounds are employed in the rubber composition used in normal solid golf ball cores, the S—S and C—S bonds will dissociate under the conditions of the vulcanization process, thereby creating radicals, which in turn will have an effect on the butadiene long chains. In other words, the compounds are believed to influence the crosslinking system between the rubber and the co-crosslinking agents, which serves to enhance rebound characteristics, while causing no hardening of the core and thereby allowing a good shot feel to be preserved.

The present invention employs specific sulfur compounds from among such compounds as described in the foregoing which are represented by aforedescribed Formulae (1) to (3) and by aforedescribed Formula (4), and in which at least one structure has a substituent constant of at least 1.42; i.e., it contains at least one electron attractive substituent group on the benzene rings bonded to the sulfur atoms. Due to the presence of the substituent groups, however, the electron densities between the S—S and the C—S decrease, meaning that the bond dissociation energy decreases, and as such the bonds will readily dissociate. The radicals which are readily produced thereby are believed to enhance the rebound characteristics even further, while maintaining the good shot feel contributed by the organic sulfur compounds as described in the foregoing. The substituent constant of at least one of the structures represented by aforedescribed Formula (4) is preferably at least 1.50, more preferably at least 1.70 and most preferably at least 2.20.

When two structures are represented by the aforedescribed Formula (4), as with the aforedescribed Formulae (2) and (3), then the greater of the aforedescribed substituent constants should fall within the aforedescribed range; it is however preferable for both to be contained within the aforedescribed range.

In the solid golf ball pertaining to the present invention, a core which comprises one or more layers is covered by a cover comprising one or more layers. The core can be obtained by heating, compressing and vulcanizing a rubber composition which essentially contains a base rubber, co-crosslinking agent, organic peroxide, filler material, and an organic sulfur compound as described in the foregoing, which contains at least one substituent group on the benzene rings, using methods and conditions typically employed for solid cores.

Natural and/or synthetic rubbers, which have been traditionally used as the base rubber in solid golf balls, can be used in the present invention, with so-called Hi-cis polybutadiene rubber having at least 40%, and preferably at least 80%, cis-1,4-bonds being preferable. According to need, the aforesaid polybutadiene rubber can be compounded with natural rubber, polyisoprene rubber, styrene polybutadiene rubber, ethylene-propylene-diene rubber (EPDM) or the like.

Examples of co-crosslinking agents include α,β-unsaturated carboxylic acids with 3 to 8 carbons, such as acrylic acid or methacrylic acid, a mono- or bivalent metal salt such as the zinc or magnesium salt of same, with zinc acrylate, which contributes high rebound characteristics, being preferred. 15 to 45 parts by weight thereof, and preferably 20 to 35 parts by weight thereof, should be compounded per 100 parts by weight base rubber. Exceeding an amount of 45 parts by weight will result in an excessive hardening of the cover and a worsening of the shot feel, while on the other hand, a compounding amount of less than 15 parts by weight will not yield high rebound characteristics, as it will require an increase in the amount of organic peroxides compounded in order to obtain an appropriate level of hardness.

The organic peroxides act as crosslinking agents or hardeners, and examples of same include dicumyl peroxide, 1,1-bis(t-butylperoxy)-3,3,5-trimethylcyclohexane, 2,5-dimethyl-2,5-di(t-butylperoxy)hexane, and di-t-butyl peroxide, with dicumyl peroxide being preferred. 0.2 to 5.0 parts by weight thereof, and preferably 1.0 to 2.5 parts by weight thereof, should be compounded per 100 parts by weight base rubber. A compounding amount of less than 0.2 parts by weight will result in excessive softening, which will prevent high rebound characteristics from being obtained, while exceeding an amount of 5.0 parts by weight will not yield high rebound characteristics, as it will require an reduction in the amount of co-crosslinking agent compounded in order to obtain an appropriate level of hardness. When these organic peroxides are heated, they decompose to form radicals, which increase the degree of crosslinking between the aforedescribed co-crosslinking agents and base rubber, and as such enhance the rebound characteristics.

A filler material is compounded as a specific gravity adjuster to adjust the specific gravity of the golf ball obtained as the finished article principally to within a range of 1.0 to 1.5, and should be a material which is normally compounded in golf ball cores; e.g., inorganic filler materials (i.e. zinc oxide, barium sulfate, or calcium carbonate), high specific gravity metal powders (e.g. tungsten powder or molybdenum powder) or mixtures of same. Zinc oxide, which exhibits a function as a vulcanization aid, is especially preferred. When zinc oxide is used, 3 to 30 parts by weight thereof, and preferably 10 to 25 parts by weight thereof, should be compounded per 100 parts by weight base rubber. A compounding amount of greater than 30 parts by weight will hinder high rebound characteristics from being obtained, as it will require an reduction in the compounding amount of co-crosslinking agent, such as zinc polyacrylate as described in the foregoing, in order to obtain an appropriate level of hardness. An amount of less than 3 parts by weight will hinder the aforedescribed specific gravity adjusting effect from occurring, and will cause the weight of the ball to decrease excessively.

One or more organic sulfur compounds selected from the group consisting of compounds which are represented by (i) the following Formula (1):

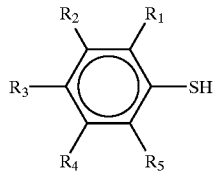

(wherein $R_1$ to $R_5$ are independently a hydrogen or a substituent group, and at least one of $R_1$ to $R_5$ is a substituent group), (ii) Formula (2)

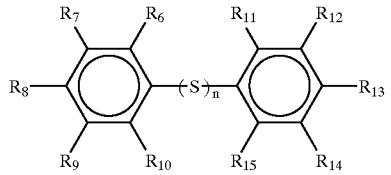

(wherein $R_6$ to $R_{15}$ are independently a hydrogen or a substituent group, at least one of $R_6$ to $R_{10}$ and at least one of $R_{11}$, to $R_{15}$ are substituent groups, and n is an integer of not less than 1), and (iii) Formula (3)

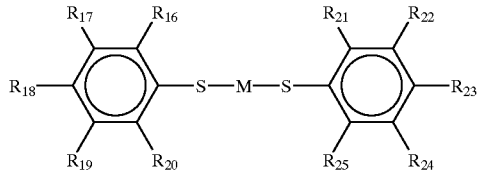

substituent group, at least one of $R_{16}$ to $R_{20}$ and at least one of $R_{21}$ to $R_{25}$ are substituent groups, and M represents a bivalent metal atom); and in which at least one structure represented by the following Formula (4):

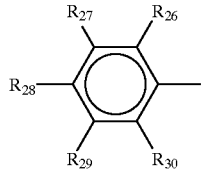

(wherein $R_{26}$ to $R_{30}$ are $R_1$ to $R_5$, $R_6$ to $R_{10}$, $R_{11}$ to $R_{15}$, $R_{16}$ to $R_{20}$, or $R_{21}$ to $R_{25}$) in Formulae (1) to (3) has a substituent constant of not less than 1.42 can be offered as examples of the organic sulfur compounds used in the present invention.

There is no particularly defined restriction on representative examples of the organic sulfur compounds represented by Formula (1) above, provided that the structure represented by Formula (4) above has a substituent constant of at least 1.42. Examples include 2,4,6-triacetylbenzenethiol (1.50), 2,3,5,6-tetraacetylbenzenethiol (1.76) and pentaacetylbenzenethiol (2.26), all of which contain an acetyl group ($COCH_3$—) as a substituent group and 2,4-di(methane sulfonyl)benzenethiol (1.44), 2,4,6-tri(methane sulfonyl)benzenethiol (2.16), 2,3,5,6-tetra(methane sulfonyl)benzenethiol (2.64) and penta(methane sulfonyl)benzenethiol (3.36), all of which contain a methane sulfonyl group as a substituent group. The figures contained in parentheses following each of the above compounds represent the substituent constant of the structure represented in Formula (4) above.

There is no particularly defined restriction on representative examples of the organic sulfur compounds represented by Formula (2) above, provided that at least one of the structures represented by Formula (4) above has a substituent constant of at least 1.42. Examples include bis(2,4,6-triacetylphenyl)disulfide (1.50), bis(2,3,5,6-tetraacetylphenyl)disulfide (1.76) and bis(pentaacetyl phenyl)disulfide (2.26), all of which contain an acetyl group as a substituent group and bis(pentabromophenyl)disulfide (1.43), which contains a bromo group as a substituent group.

There is no particularly defined restriction on representative examples of the organic sulfur compounds represented by Formula (3) above, provided that at least one of the structures represented by Formula (4) above has a substituent constant of at least 1.42. Examples include 2,4,6-tri (methane sulfonyl)benzenethiol zinc salt (1.47), 2,3,5,6-tetra(methane sulfonyl)benzenethiol zinc salt (2.02) and penta(methane sulfonyl)benzenethiol zinc salt (2.51), all of which contain a methane sulfonyl group as a substituent group. The figures contained in parentheses following each of the above compounds represent the larger of the substituent constants of the structure represented in Formula (4) above.

An example of the method used to determine the substituent constant in the present invention can be described in detail as follows: given an organic sulfur compound which is represented by Formula (2) below

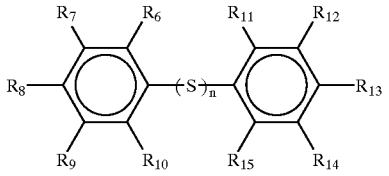

(where $R_6$ to $R_{15}$ are all bromo groups and n is 2); or is, in other words, a bis(pentabromophenyl)disulfide, then in the structure represented by Formula (4) from Formula (2) below

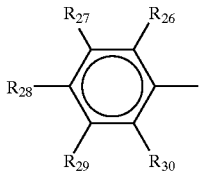

(where $R_{26}$ to $R_{30}$ are all bromo groups), the substituent constant of the bromo group in the ortho position is 0.21, in the meta position is 0.39 and in the para position is 0.23; therefore, by taking the total of the five, the substituent constant of Formula (4) above is 1.43. Although there are two of the structures represented by Formula (4) above in the structure of the bis(pentabromo phenyl)disulfide, both have the same structure and therefore, the substituent constant is 1.43. Furthermore, when there are a plurality of substituent groups in Formula (4) above, as in the aforedescribed case, no effect between the substituent groups is observed.

A reference value; e.g., as in "Linear Free Energy Relationships", P. R. Wells, pp. 171 to 219 or "An Introduction to Organic Chemistry", K. Maruyama et al, p. 113, Apr. 1, 1989, Kagaku-Dojin Publishing Co., Ltd. is used for the substituent constant used in the present invention.

The organic sulfur compounds as described in the foregoing should be compounded in an amount of 0.05 to 3.0 parts by weight, and preferably 0.1 to 2.0 parts by weight per 100 parts by weight base rubber. At amounts of less than 0.05 parts by weight, the effect of enhancing the rebound characteristics cannot be sufficiently exhibited, whereas at amounts in excess of 3.0 parts by weight, the compression deformation quantity increases, which causes a decrease in the rebound characteristics.

Antioxidants, peptizing agents or any other component which is normally used in the manufacture of solid golf ball cores may also be compounded in a suitable amount in the core of the golf ball pertaining to the present invention. It is preferable for the amount of antioxidant to be 0.2 to 0.5 parts by weight per 100 parts by weight base rubber.

The core can be obtained by using kneading rolls or another suitable kneader to knead the rubber composition until uniform and then vulcanizing the kneaded article in a mould. There are no particular restrictions on the conditions employed in such circumstances, but a temperature between 130 and 240° C., a pressure between 2.9 and 11.8 MPa and a time of 15 to 60 minutes are typical.

It is preferable for the deformation of the core of the golf ball pertaining to the present invention to be 2.0 to 6.0 mm and even more preferably 2.8 to 4.5 mm when measured from a state where an initial load of 98 N has been applied to when a final load of 1275 N has been applied. If the amount is less than 2.0 mm, the core will become too hard, resulting in a golf ball having a diminished shot feel, whereas if the amount exceeds 6.0 mm, then the core will become too soft, resulting in a golf ball having reduced durability, and reduced flight distance as a result of decreased rebound characteristics.

It is preferable in the present invention for the core diameter to be 32.8 to 40.8 mm and more preferably 33.6 to 40.0 mm. If the diameter is less than 32.8 mm, then rebound characteristics will be reduced and so will flight distance, whereas if the diameter is greater than 40.8 mm, then the cover will be too thin, which will lead to reduced durability.

The core used in the golf ball pertaining to the present invention may be of a single-layered structure, or a multi-layered structure comprising two or more layers. It is preferable for the volume of the core component which has been compounded as described in the foregoing to be at least 30% with respect to the total core, preferably at least 50% of same, even more preferably at least 70% of same, and still even more preferably 100% of same. A cover is subsequently applied to a core obtained as described in the foregoing.

The cover used in the golf ball pertaining to the present invention may comprise a single-layered structure, or a multi-layered structure comprising two or more layers. The cover pertaining to the present invention contains a thermoplastic resin; in particular an ionomer resin which is normally used in golf ball covers, as a backing resin. Examples of the aforedescribed ionomer resin include resins in which at least a portion of the carboxyl groups in ethylene and α,β-unsaturated carboxylic acid copolymers have been neutralized with metal ions, or resins in which at least a portion of the carboxyl groups in ethylene, α,β-unsaturated carboxylic acid and α,β-unsaturated carboxylic acid ester ternary copolymers have been neutralized with metal ions. Examples of the α,β-unsaturated carboxylic acid include acrylic acid, methacrylic acid, fumaric acid, maleic acid and crotonic acid, with acrylic acid and methacrylic acid being especially preferred. Examples of the α,β-unsaturated carboxylic acid ester metal salt include the methyl, ethyl, propyl, n-butyl or isobutyl esters of acrylic acid, methacrylic acid, fumaric acid and maleic acid, with acrylic acid esters and methacrylic acid esters being especially preferred. Examples of the metal ions with which at least a portion of the carboxyl groups in an ethylene and α,β-unsaturated carboxylic acid copolymer or of the carboxyl groups in an ethylene, α,β-unsaturated carboxylic acid and α,β-unsaturated carboxylic acid ester ternary copolymer have been neutralized include sodium, potassium, lithium, magnesium, calcium, zinc, barium, aluminum, tin, zirconium and cadmium ions, amongst which sodium, zinc and magnesium ions are preferably used due to their [contribution to] rebound characteristics and durability.

Specific examples of the ionomer resin are not limited to the above; Hi-milan 1555, 1557, 1605, 1652, 1702, 1705, 1706, 1707, 1855, and 1856 (Du Pont-Mitsui Polychemical Co., Ltd.), Surlyn 8945, 9945, AD 8511, AD 8512 and AD 8542 (Du Pont Inc.), and Iotek 7010 and 8000 (Exxon Chemical Inc.) can all be given as examples. The aforesaid ionomers may each be used alone or in combinations of two or more.

Examples of preferable materials to be used in the cover pertaining to the present invention are not limited to the aforedescribed ionomer resins; the ionomer resin can be used together with one or more thermoplastic elastomers or diene-based block copolymers. Specific examples of the aforedescribed thermoplastic elastomers include polyamide-based thermoplastic elastomers sold commercially under the trade name "Pebax" (e.g., Pebax 2533) by Toray (KK); polyester-based thermoplastic elastomers sold commercially under the trade name "Hytrel" (e.g., Hytrel 3548 and Hytrel 4047) by Toray-Du Pont (KK) and polyurethane-based thermoplastic elastomers sold commercially under the trade name "Elastollan" (e.g., Elastollan ET880) by Takeda-Badische Urethane Industries (KK).

The aforedescribed diene-based block copolymer contains double bonds which derive from conjugated diene compounds from block copolymers or partially hydrogenated block copolymers. A block copolymer based thereupon refers to a block copolymer comprising a polymer block A, principally based upon at least one vinyl aromatic compound and a polymer block B based principally based upon at least one conjugated diene compound. A partially hydrogenated block copolymer refers to a copolymer which has been obtained by adding hydrogen to the aforedescribed block copolymers. One or more examples of the vinyl aromatic compound which constitute the block copolymer can be selected from among the group comprising styrene, □-methyl styrene, vinyl toluene, p-t-butyl styrene and 1,1-diphenyl styrene, with styrene being preferable. One or more examples of the conjugated diene compound can be selected from among the group comprising butadiene, isoprene, 1,3-pentadiene, 2,3-dimethyl-1,3-butadiene, with butadiene, isoprene and combinations of same being preferable. A specific example of the aforedescribed diene-based block copolymer includes the product marketed commercially under the trade name "Epofriend" and produced by Daicel Chemical Industry Co., Ltd. (e.g. Epofriend A1010).

The amount of the aforedescribed thermoplastic elastomer and diene-based block copolymer to be compounded per 100 parts by weight cover backing resin is 0 to 60 parts by weight and preferably 10 to 40 parts by weight. If the amount exceeds 60 parts by weight, then the cover will become too soft, which will prompt a decrease in rebound characteristics, and will also adversely affect the compatibility with the ionomer resin, which will tend to reduce durability.

Other than the aforesaid backing resin, any of various additives; e.g., pigments such as titanium dioxide, dispersants, antioxidants, UV absorbers, photostabilizers and filler materials which are similar to those used in the core, may be added as needed to the cover pertaining to the present invention.

There are no particular limitations on the method used for applying the aforesaid cover, provided that it is a known cover-application method. Methods which can be used involve either preforming the cover composition into semi-spherical half-shells, encasing the core in two of these molded articles, conducting a molding process under applied pressure for 1 to 5 minutes at 130 to 170° C. or injection molding the aforesaid cover composition directly onto the core and thereby encasing the core in the cover.

The thickness of the aforedescribed cover should be 1.0 to 5.0 mm, preferably 1.4 to 4.6 mm, and even more preferably 1.4 to 2.5 mm. If the cover thickness is less than 1.0 mm, then it will be too thin to prevent a decrease in durability and rebound characteristics, while if it is greater than 5.0 mm, then shot feel will diminish. During the molding of the cover, dimples can be formed in the ball surface as needed, and once the cover has been molded, it can be painted or stamped as needed.

EXAMPLES

The present invention shall next be described in further detail by means of Examples. The present invention shall not be limited to these examples.

Fabrication of the Core

Examples 1 to 9 and Comparative Examples 1 to 5

Core rubber compositions compounded from the items given in Tables 1 to 2 (Examples) and Table 3 (comparative examples) were kneaded with kneading rolls and hot-pressed for 30 min at 160° C. in a mould, to yield cores which were 38.4 mm in diameter. The deformation amount and coefficient of restitution were measured for each of the cores obtained, and the results are displayed in Tables 5 to 6 (Examples) and Table 7 (comparative examples).

Example 10

(i) Fabrication of Spherical Vulcanized Molded Article for Inner Layer Core

An inner layer core rubber composition compounded from the items given in Table 2 was kneaded with kneading rolls and hot-pressed for 25 min at 160° C. in a mould, to yield a spherical vulcanized molded article for an inner layer core which was 28.0 mm in diameter.

(ii) Fabrication of Semi-spherical Semi-vulcanized Molded Article for Outer Layer Core An outer layer core rubber composition compounded from the items given in Table 2 was kneaded with kneading rolls and hot-pressed for 2 min at 160° C. in an insert mold, in which the diameter of the insert portion was the same as that of the spherical vulcanized molded article for the inner layer core as fabricated in (i), to yield a semi-spherical vulcanized molded article for an outer layer core.

(iii) Fabrication of Dual-layer Core

The spherical vulcanized molded article for the inner layer core which was fabricated in (i) above was sandwiched between two of the semi-spherical semi-vulcanized molded articles for the outer layer core which were fabricated in (ii) above and hot-pressed for 25 min at 160° C. in a mould, to yield a dual-layer core which was 38.2 mm in diameter. The deformation amount and coefficient of restitution of the resulting dual-layer core were measured and the results displayed in Table 6 (Examples).

TABLE 1

(part by weight)

| Core composition | Example No. 1 | 2 | 3 | 4 | 5 |
|---|---|---|---|---|---|
| BR-11 *1 | 100 | 100 | 100 | 100 | 100 |
| Zinc acrylate | 30 | 15 | 45 | 30 | 30 |
| Zinc oxide | 20 | 25.4 | 14.6 | 20 | 20 |
| Dicumyl peroxide | 0.5 | 0.5 | 0.5 | 0.5 | 0.5 |
| 2,4,6-triacetylbenzene-thiol (1.50) | 0.5 | 0.5 | 0.5 | 0.05 | 3.0 |
| bis (2,3,5,6-tetraacetyl-phenyl) disulfide (1.76) | — | — | — | — | |
| 2,3,4,5,6-pentaacetylbenzenethiol zinc salt (2.26) | — | — | — | — | |

TABLE 2

(parts by weight)

| Core composition | Example No. 6 | 7 | 8 | 9 | 10 Inner layer | 10 outer layer |
|---|---|---|---|---|---|---|
| BR-11 *1 | 100 | 100 | 100 | 100 | 100 | 100 |
| Zinc acrylate | 30 | 30 | 10 | 50 | 30 | 30 |
| Zinc oxide | 20 | 20 | 27.2 | 12.8 | 20 | 20 |
| Dicumyl peroxide | 0.5 | 0.5 | 3.0 | 0.5 | 0.5 | 0.5 |
| 2,4,6-triacetylbenzene-thiol (1.50) | — | — | 0.5 | 0.5 | 0.5 | — |
| bis (2,3,5,6-tetraacetylphenyl) disulfide (1.76) | 0.5 | — | — | — | — | — |
| 2,3,4,5,6-pentaacetylbenzene-thiol zinc salt (2.26) | — | 0.5 | — | — | — | — |
| Thiobenzoic acid (0) | — | — | — | — | — | — |
| Diphenyl disulfide (0) | — | — | — | — | — | 0.5 |
| Pentachlorothio-phenol zinc salt (1.37) | — | — | — | — | — | — |

TABLE 3

(part by weight)

| Core composition | Comparative Example No. 1 | 2 | 3 | 4 | 5 |
|---|---|---|---|---|---|
| BR-11 *1 | 100 | 100 | 100 | 100 | 100 |
| Zinc acrylate | 30 | 30 | 30 | 30 | 45 |
| Zinc oxide | 20 | 20 | 20 | 20 | 14.6 |
| Dicumyl peroxide | 0.5 | 0.5 | 0.5 | 0.5 | 0.5 |
| Thiobenzoic acid (0) | — | — | 0.5 | — | — |
| Diphenyl disulfide (0) | — | 0.5 | — | — | 0.5 |
| Pentachlorothiophenol zinc salt (1.37) | — | — | — | 0.5 | — |

*1 Trade name; Hi-cis polybutadiene rubber (JSR (KK))

Preparation of Cover Composition

The materials listed in Table 4 below were mixed using a kneading type twin-screw extruder to yield cover compositions in the form of pellets. The conditions for extrusion were as follows:

Screw diameter: 45 mm

Screw rotation: 200 rpm

Screw L/D: 35

The blended materials were heated in the extruder die at 200 to 260° C.

TABLE 4

| Cover composition | Amount (part by weight) |
|---|---|
| Hi-milan 1706 *2 | 30 |
| Hi-milan 1707 *3 | 30 |
| Hi-milan 1605 *4 | 40 |
| Titanium dioxide | 2 |
| Barium sulfate | 2 |

*2 Hi-milan 1706 (trade name), ethylene-methacrylic acid copolymer-based ionomer resin obtained by neutralizing with zinc ion, manufactured by Mitsui Du Pont Polychemical Co., Ltd.
*3 Hi-milan 1707 (trade name), ethylene-methacrylic acid copolymer-based ionomer resin obtained by neutralizing with sodium ion, manufactured by Mitsui Du Pont Polychemical Co., Ltd.
*4 Hi-milan 1605 (trade name), ethylene-methacrylic acid copolymer-based ionomer resin obtained by neutralizing with sodium ion, manufactured by Mitsui Du Pont Polychemical Co., Ltd.

Examples 1 to 10 and Comparative Examples 1 to 5

Golf balls of a 42.8 mm diameter were fabricated by pre-forming the resulting cover compositions into semi-spherical half-shells, two of which were encased around cores, then applying pressure to form a cover layer 2.3 mm thick. A paint was then applied to the surfaces of same. The flight distances of the resulting golf balls were measured, and the shot feel of the balls was assessed; the results are displayed in Tables 5 to 6 (Examples) and Table 7 (Comparative Examples). The testing method is described hereunder.

Testing Method (1) Deformation Amount of Core

The deformation amount was measured from when an initial load of 98 N had been applied to the cores to when a final load of 1275 N had been applied.

(2) Coefficient of Restitution

A 198.4 g metal cylindrical article was caused to collide with each golf ball at a velocity of 40 m/sec. The velocity of the golf balls and the above cylindrical article before and after impact were measured, and the coefficient of restitution for each of the balls was calculated from their respective velocities and weights. Measurements were conducted 12 times on each golf ball, with the average value of same being taken as the coefficient of restitution for each ball.

(3) Flight Distance

A No. 1 wood club with a metal head (W#1, driver) was fitted to a swing robot (True Temper Co.), and the flight distance (carry) of the golf balls was measured from where the club struck the balls at a head speed of 45 m/sec to where the ball fell. Measurements were conducted 12 times on each golf ball, with the average value of same being taken as the final result.

(4) Shot Feel

A live test was performed with ten golfers using a No.1 wood club (New Breed Tour Forged driver, W#1; manufactured by Sumitomo Rubber Industries, Ltd.; loft angle: 8.5°). The shot feel for each of the golf balls was obtained by assessing the magnitude of shock on impact and taking the assessments which occurred most often. The criteria for evaluation are given hereunder.

Evaluation Criteria oo: Good. There was virtually no shock on impact and shot feel was very soft.

o: Good. There was little shock on impact and the shot feel was soft.

Δ: Normal shock on impact x: Marked shock on impact and poor shot feel.

TABLE 5

| | Example No. | | | | |
|---|---|---|---|---|---|
| Test item | 1 | 2 | 3 | 4 | 5 |
| Deformation amount of core (mm) | 3.72 | 4.65 | 2.73 | 3.50 | 3.96 |
| Coefficient of restitution of core | 0.792 | 0.772 | 0.808 | 0.793 | 0.785 |
| Carry (m) | 203 | 199 | 207 | 203 | 200 |

TABLE 6

| | Example No. | | | | |
|---|---|---|---|---|---|
| Test item | 6 | 7 | 8 | 9 | 10 |
| Deformation amount of core (mm) | 3.55 | 3.70 | 5.10 | 2.45 | 3.50 |
| Coefficient of restitution of core | 0.797 | 0.797 | 0.763 | 0.809 | 0.793 |
| Carry (m) | 204 | 204 | 192 | 208 | 202 |

TABLE 7

| | Comparative Example No. | | | | |
|---|---|---|---|---|---|
| Test item | 1 | 2 | 3 | 4 | 5 |
| Deformation amount of core (mm) | 3.01 | 3.35 | 3.50 | 3.60 | 2.62 |
| Coefficient of restitution of core | 0.776 | 0.780 | 0.778 | 0.778 | 0.791 |
| Carry (m) | 195 | 197 | 197 | 197 | 202 |

The data above were used to plot the relationship between the core compression deformation (x axis) and the coefficient of restitution of the core (y axis) for Examples 1 to 10 and Comparative Examples 1 to 5, and the results can be seen in FIG. 1. In the plot, the compression deformation increases further along the X-axis, heading right, while the shock on impact decreases; these data reveal golf balls having exceptional shot feel. On the other hand, the coefficient of restitution increases further along the Y-axis, heading upwards; these data reveal golf balls having an enhanced flight distance. Accordingly, the data which are uppermost and rightmost in the plot reveal golf balls with exceptional shot feel and rebound characteristics (flight distance). As is readily understood from the figure, Examples 1 to 10 pertaining to the present invention, in which organic sulfur compounds having a specific substituent constant were present in the core rubber composition, all lie within the upper right-hand region of the plot, as compared with the golf balls pertaining to Comparative Examples 1 to 5, which did not contain the aforedescribed organic sulfur compounds. In general, the compression deformation value in golf balls is set according to the performance demanded thereof. However, FIG. 1 shows that the coefficient of restitution of all of the Examples were greater than those of the Comparative Examples, irrespective of the compression deformation value. In other words, the rebound characteristics of golf balls which had similar degrees of compression deformation (shot feel) was exceptional in those balls pertaining to the Examples. Similarly, the compression deformation of golf balls which had similar degrees of rebound characteristics (flight distance) was high, and the shot feel good, in those balls pertaining to the Examples. To corroborate these findings, an evaluation of shot feel was conducted on Examples 1, 4 and 10 and Comparative Example 5, all of which had nearly identical coefficient of restitution, alongside Examples 1, 4, and 10 and Comparative Examples 3 and 4, all of which had nearly identical compression deformation values. The results, which are displayed in Table 8 below, are displayed with core compression deformation and coefficient of restitution, together with ball flight distance. The testing method was as described in the foregoing.

TABLE 8

| | Example No. | | | Comparative Example No. | | |
|---|---|---|---|---|---|---|
| Test item | 1 | 4 | 10 | 3 | 4 | 5 |
| Deformation amount of core (mm) | 3.72 | 3.50 | 3.50 | 3.50 | 3.60 | 2.62 |
| Coefficient of restitution of core | 0.792 | 0.793 | 0.793 | 0.778 | 0.778 | 0.791 |
| Carry (m) | 203 | 203 | 202 | 197 | 197 | 202 |
| Shot feel | oo | oo | oo | oo | oo | x |

As can be clearly understood from the data given in Table 8, the golf balls pertaining to Examples 1, 4 and 10 and to Comparative Example 5 had coefficient of restitution which were nearly the same, while the golf balls pertaining to Examples 1, 4, and 11 [sic], which displayed very high compression deformation had markedly superior shot feel in comparison to the ball pertaining to Comparative Example 6. Furthermore, the golf balls pertaining to Examples 1, 4, and 10 and to Comparative Examples 3 and 4 all had similar compression deformation values and shot feel, while the golf balls pertaining to Examples 1, 4 and 10 exhibited significantly higher coefficient of restitution and flight distance values in comparison to the balls pertaining to Comparative Examples 3 and 4.

By employing specific organic sulfur compounds which contain substituent groups having a substituent constant of at least 1.42 in the core rubber composition in the solid golf ball pertaining to the present invention, exceptional rebound characteristics and flight performance can be obtained, as can an enhanced shot feel.

What is claimed is:

1. A solid golf ball comprising at least one core layer, and at least one cover layer formed on the at least one core layer, wherein said at least one core layer is formed by vulcanizing and press-molding a rubber composition comprising (a) a base rubber, (b) a co-crosslinking agent, (c) an organic peroxide, (d) a filler material, and (e) at least one organic sulfur compound selected from the group consisting of (i) a compound represented by the following Formula (1):

(3)

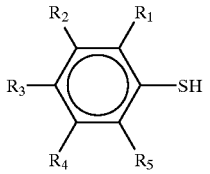

wherein $R_1$ to $R_5$ are independently a hydrogen or a substituent group, and at least one of $R_1$ to $R_5$ is a substituent group, (ii) a compound represented by the following Formula (2)

(2)

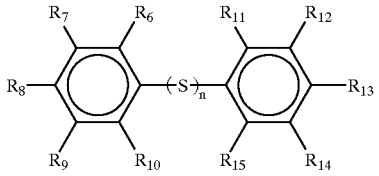

wherein $R_6$ to $R_{15}$ are independently a hydrogen or a substituent group, at least one of $R_6$ to $R_{10}$ and at least one of $R_{11}$ to $R_{15}$ are substituent groups, and n is an integer of not less than 1, and (iii) a compound represented by the following Formula (3)

(3)

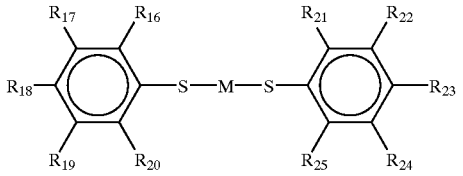

wherein $R_{16}$ to $R_{25}$ are independently a hydrogen or a substituent group, at least one of $R_{16}$ to $R_{20}$ and at least one of $R_{21}$ to $R_{25}$ are substituent groups, and M represents a bivalent metal atom;

and wherein at least one structure represented by the following Formula (4) in the compounds represented by formula (1) to (3):

(4)

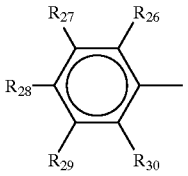

has a substituent constant of not less than 1.50 wherein $R_{26}$ to $R_{30}$ correspond to either $R_1$ to $R_5$ in Formula (1), $R_6$ to $R_{10}$ in Formula (2), $R_{11}$ to $R_{15}$ in Formula (2), $R_{16}$ to $R_{20}$ in Formula (3), or $R_{21}$ to $R_{25}$ in Formula (3).

2. The golf ball according to claim 1, wherein the rubber composition for the core comprises 0.05 to 3 parts by weight of the organic sulfur compound, 15 to 45 parts by weight of the co-crosslinking agent, 0.2 to 5 parts by weight of the organic peroxide and 2 to 30 parts by weight of the filler, based on 100 parts by weight of the base rubber.

3. The golf ball according to claim 1, wherein the base rubber is polybutadiene rubber containing a cis-1,4-bond of not less than 40%.

4. The golf ball according to claim 2, wherein the base rubber is polybutadiene rubber containing a cis-1,4-bond of not less than 40%.

5. The golf ball according to claim 1, wherein the compound represented by formula (1) is selected from the group consisting of 2,4,6-triacetylbenzenethiol 2,3,5,6-tetraacetylbenzenethiol pentaacetylbenzenethiol 2,4,6-tri (methane sulfonyl)benzenethiol 2,3,5,6-tetra(methane sulfonyl)benzenethiol and penta(methane sulfonyl)benzene thiol.

6. The golf ball according to claim 1, wherein the compound represented by formula (2) is selected from the group consisting of bis (2,4,6-triacetylphenyl)disulfide bis (2,3,5,6-tetraacetylphenyl) disulfide and bis (pentaacetyl phenyl) disulfide.

7. The golf ball according to claim 1, wherein the compound represented by formula (3) is selected from the group consisting of 2,4,6-tri (methane sulfonyl)benzenethiol zinc salt, 2,3,5,-tetra(methane sulfonyl)benzene thiol zinc salt, and penta(methane sulfonyl)benzenethiol zinc salt.

8. The golf ball according to claim 1, wherein the structure defined by formula (4) is a derivative of a compound selected from the group consisting of 2,4,6-triacetylbenzene, 2,3,5,6-tetraacetylbenzene, pentaacetylbenzene, 2,4,6-tri (methane sulfonyl)benzene, 2,3,5,6-tetra(methane sulfonyl) benzenethiol, and penta (methane sulfonyl) benzene.

* * * * *